US011435063B2

(12) United States Patent
Lee

(10) Patent No.: US 11,435,063 B2
(45) Date of Patent: Sep. 6, 2022

(54) CONNECTING STRUCTURE FOR LAMP BULB AND LAMP BASE

(71) Applicant: DONGGUAN GATEWAY PLASTIC AND HARDWARE LIGHTING CO., LTD., Dongguan (CN)

(72) Inventor: James Lee, Dongguan (CN)

(73) Assignee: DONGGUAN GATEWAY PLASTIC AND HARDWARE LIGHTING CO., LTD., Dongguan (CN)

( * ) Notice: Subject to any disclaimer, the term of this patent is extended or adjusted under 35 U.S.C. 154(b) by 0 days.

(21) Appl. No.: 17/393,352

(22) Filed: Aug. 3, 2021

(65) Prior Publication Data

US 2021/0364153 A1 Nov. 25, 2021

(51) Int. Cl.
*F21V 21/002* (2006.01)
*F21V 23/06* (2006.01)

(52) U.S. Cl.
CPC ..... *F21V 21/002* (2013.01); *F21V 23/06* (2013.01)

(58) Field of Classification Search
CPC ..... F21V 17/06; F21V 21/002; F21V 21/008; F21V 23/06; H01R 4/2404; F21S 4/10
See application file for complete search history.

(56) References Cited

U.S. PATENT DOCUMENTS 6,065,855 A * 5/2000 Hwang ..... F21V 21/002 362/249.01
6,974,347 B1 * 12/2005 Lin ..... F21V 21/002 439/419
2017/0138577 A1 * 5/2017 Lin ..... H02G 15/117
2018/0372278 A1 * 12/2018 Zhang ..... F21K 9/232

* cited by examiner

*Primary Examiner* — Britt D Hanley

(57) ABSTRACT

The present invention discloses a connecting structure for a lamp bulb and a lamp base, including a light bulb housing, a plastic lamp base, and two conducting wires. A filament mount is fixedly connected inside the plastic lamp base. A filament is fixedly connected to the filament mount. A light-guiding post is fixedly connected to the filament mount. A connecting member for connecting the two conducting wires to the plastic lamp base is disposed on the two conducting wires. Problems that existing light bulbs have a relatively long production time and are relatively inconvenient to assemble and disassemble are resolved, thereby greatly improving the efficiency of production.

5 Claims, 4 Drawing Sheets

CONNECTING STRUCTURE FOR LAMP BULB AND LAMP BASE

TECHNICAL FIELD

The present invention relates to the technical field of lamp bulbs, and specifically, to a connecting structure for a lamp bulb and a lamp base.

BACKGROUND

A lamp bulb, which is a lighting source that emits light and heat by using electrical energy, was invented by Henry Goebel (in fact Edison found appropriate materials, that is, he invented incandescent lamps with high applicability, and lamp bulbs appeared early in the year 1854). The most common function of lamp bulbs is lamping. Along with the development of society, the uses of lamp bulbs keep changing. Initially, lamp bulbs may be used to facilitate production and daily life. However, with the progress of society, the uses of lamp bulbs change significantly, and functional lamps with a variety of uses such as vehicle, landscaping, and decoration have emerged.

During the production of an existing lamp bulb, a conducting wire needs to be connected to a filament through soldering. Such a production process takes a relatively long time is relatively low in efficiency. In addition, it is difficult to disassemble soldering points during assembly and disassembly. As a result, the process of assembly, disassembly, and replacement is relatively laborious. Such a production process reduces the efficiency of production of lamp bulbs and is also not beneficial to the assembly, disassembly, and maintenance of lamp bulbs during later use. In view of this, a lamp bulb-lamp base connecting structure is proposed.

SUMMARY

An objective of the present invention is to provide a lamp bulb that is convenient to produce and can be rapidly assembled and disassembled, to at least resolve some of the foregoing problems in the prior at.

To achieve the foregoing objective, the present invention provides the following technical solution: A connecting structure for a lamp bulb and a lamp base includes a lamp bulb housing, a plastic lamp base, and two conducting wires. A filament mount is fixedly connected inside the plastic lamp base. A filament is fixedly connected to the filament mount. A light-guiding post is fixedly connected to the filament mount. The lamp bulb housing is threadedly connected to the plastic lamp base. A connecting member for connecting the two conducting wires to the plastic lamp base is disposed on the two conducting wires, thereby facilitating the assembly and disassembly, improving the efficiency of production, and making later use more convenient for people.

Preferably, the connecting member includes a cover and a copper nail. A first fixed block is fixedly connected to a top surface of the plastic lamp base. The first fixed block is provided with two first conducting wire grooves each provided with a first insertion hole. The cover is provided with two clamping grooves. The cover and the first fixed block are plugged to each other. The two conducting wires are slidably connected to the two first conducting wire grooves and the two clamping grooves, respectively. The cover is provided with a second insertion hole. The conducting wire is provided with a third insertion hole. The filament mount is provided with a fourth insertion hole. The copper nail is plugged in all the first insertion hole, the second insertion hole, the third insertion hole, and the fourth insertion hole. According to the connecting structure, two copper nails are used to rapidly fix the conducting wires on the plastic lamp base and directly transfer electrical energy from the conducting wires to the filament, thereby greatly improving the efficiency of production.

Preferably, the first conducting wire groove has a semicircular cross section, and an outer side wall of the conducting wire is tightly attached to an inner wall of the first conducting wire groove, thereby ensuring that the conducting wire can be stably disposed inside the first conducting wire groove.

Preferably, the first insertion holes in the two first conducting wire grooves are staggered from each other. The two first insertion holes are staggered from each other to prevent the two copper nails from getting excessively close to cause short circuit of the conducting wires.

Preferably, a connecting groove in communication with the first insertion hole is provided in the bottom of the plastic lamp base. A connecting post body corresponding to the connecting groove is protrudingly disposed on a surface of the filament mount. The fourth insertion hole penetrates through the connecting post body. The filament mount is plugged in the connecting groove of the plastic lamp base by the connecting post body to implement assembly. Such a design can facilitate the assembly and disassembly of the plastic lamp base and the filament mount.

Preferably, a positioning lug is protrudingly disposed on an outer side of one connecting post body, and a lug groove is communicatively provided on a side of the connecting groove corresponding to the connecting post body. The positioning lug can be used as a basic fool-proof design, to avoid reverse connection of positive and negative electrodes.

Compared with the prior art, the beneficial effects of the present invention are as follows:

The present invention resolves problems that existing lamp bulbs have a relatively long production time and are relatively inconvenient to assemble and disassemble. According to the connecting structure of the present invention, two copper nails are used to rapidly fix conducting wires on a plastic lamp base and directly transfer electrical energy from the conducting wires to a filament, thereby greatly improving the efficiency of production, facilitating assembly and disassembly, and making later use more convenient for people.

Figure 1:
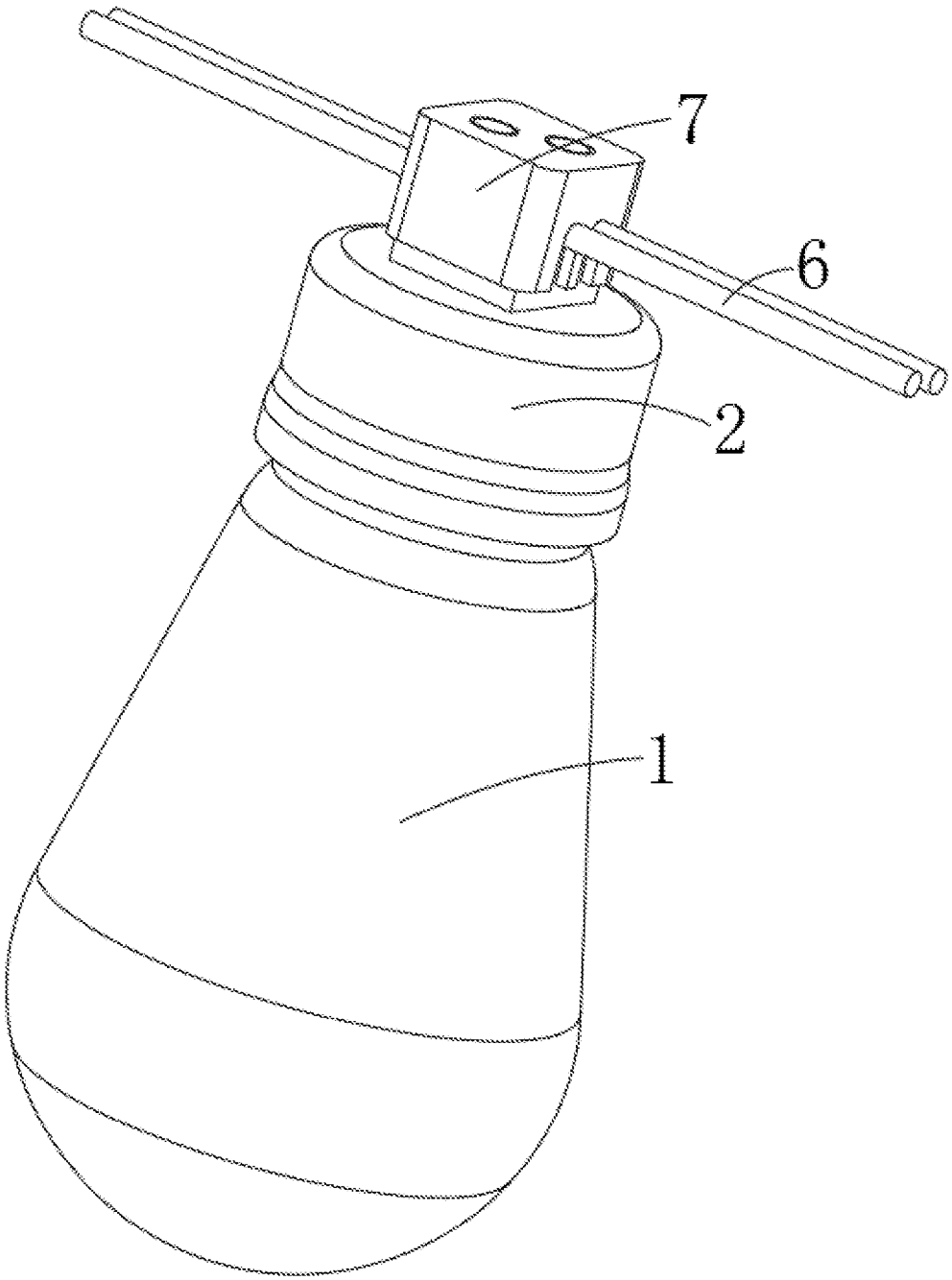
FIG. 1 is an overall schematic structural diagram of the present invention.

In the drawings: 1—lamp bulb housing; 2—plastic lamp base; 3—filament mount; 4—filament; 5—light-guiding post; 6—conducting wire; 7—connecting member; 8—cover; 9—copper nail; 10—first fixed block; 11—first conducting wire groove; 12—first insertion hole; 13—clamping groove; 14—second insertion hole; 15—third insertion hole; 16—fourth insertion hole; 17—connecting groove; 171—lug groove; 18—connecting post body; and 181—positioning lug.

DETAILED DESCRIPTION

The following clearly and completely describes the technical solutions in the embodiments of the present invention with reference to the accompanying drawings in the embodiments of the present invention. Apparently, the described embodiments are only some embodiments of the present invention rather than all the embodiments. All other embodiments obtained by a person of ordinary skill in the art based on the embodiments of the present invention without creative efforts fall within the protection scope of the present invention.

Figure 2:
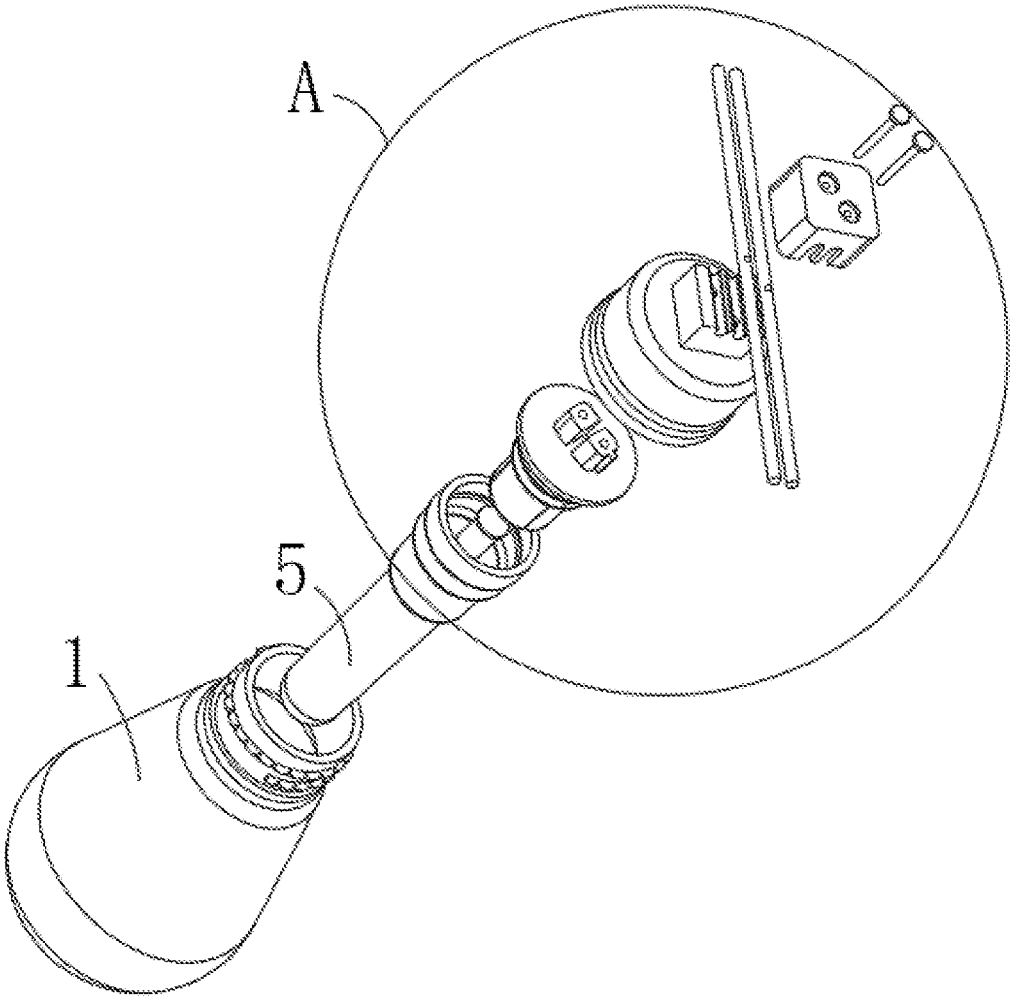
FIG. 2 is an overall structural exploded view of the present invention.
Figure 3:
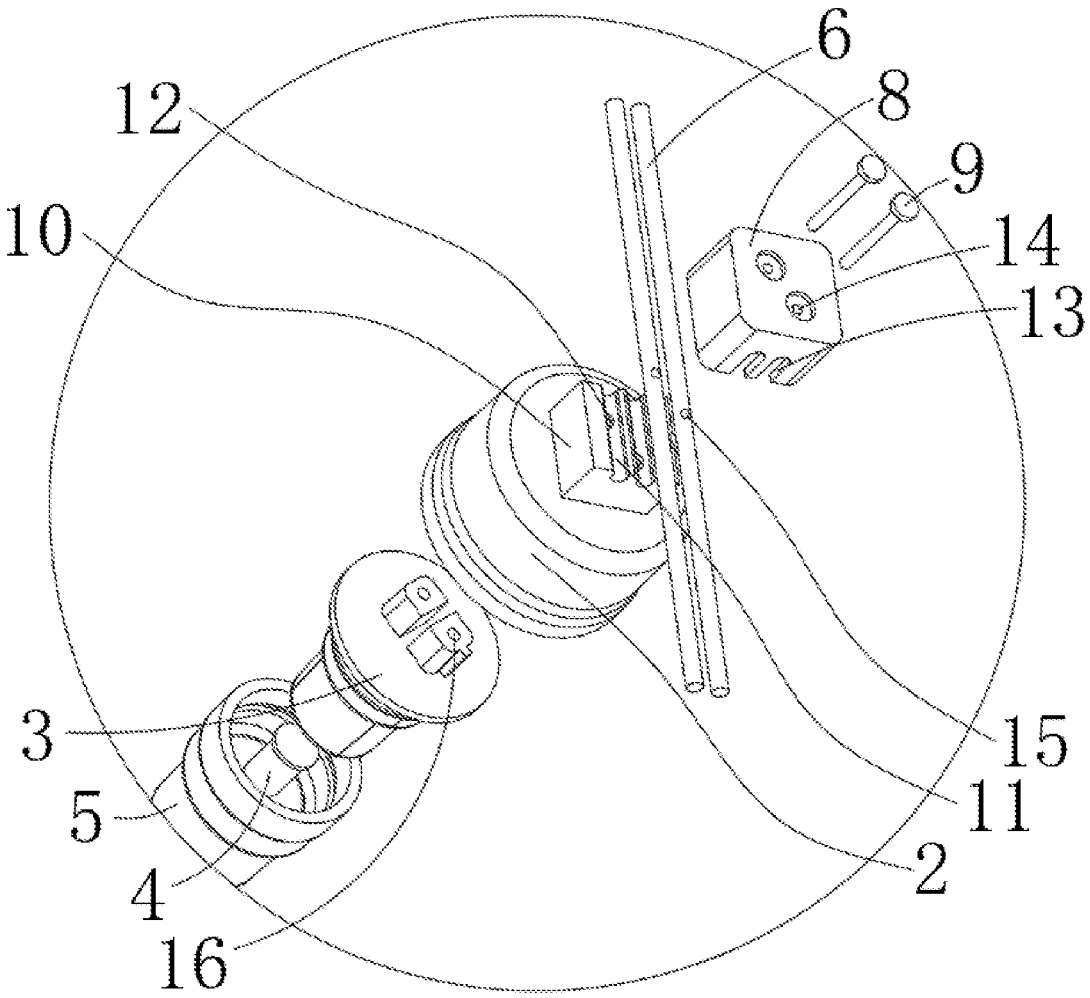
FIG. 3 is an enlarged view of a region A in FIG. 2.
Figure 4:
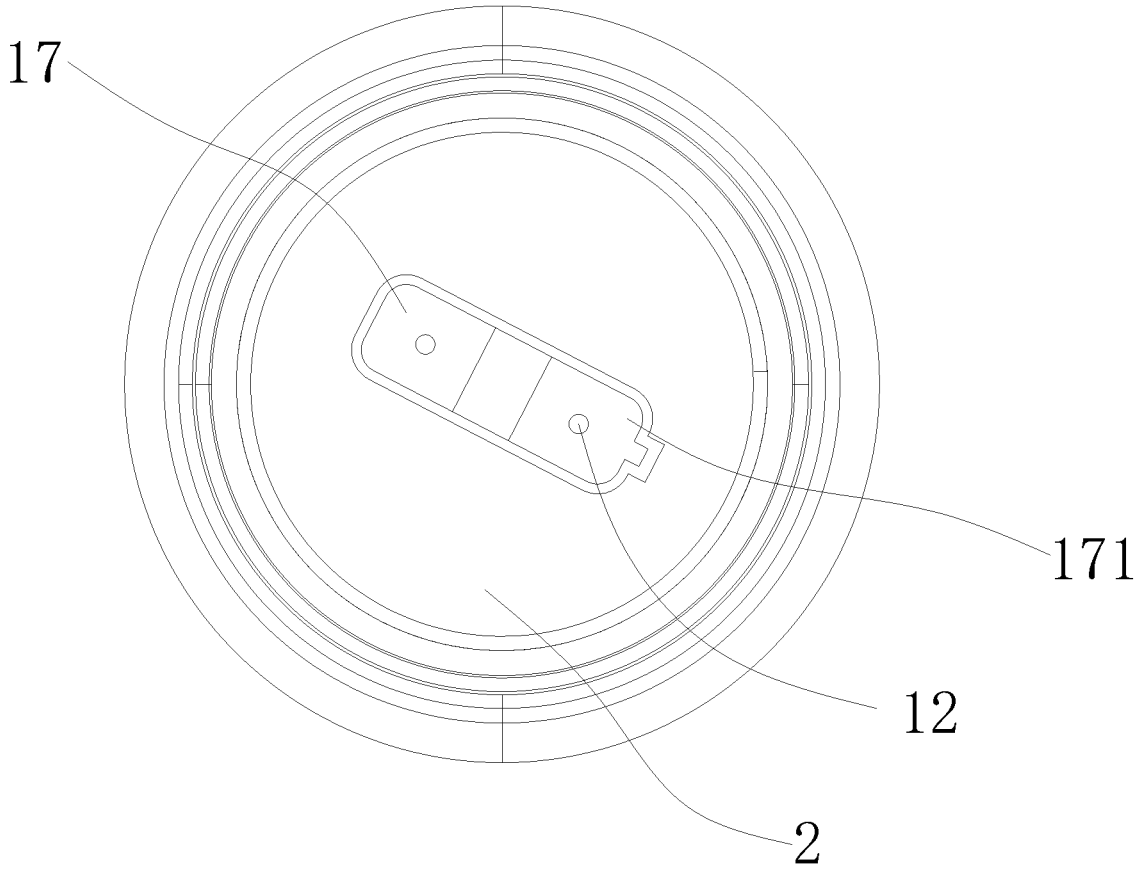
FIG. 4 is a bottom view of a plastic lamp base according to the present invention.

Referring to FIG. 1 to FIG. 4, a connecting structure for a lamp bulb and a lamp base shown in the figures includes a lamp bulb housing 1, a plastic lamp base 2, and two conducting wires 6. A filament mount 3 is fixedly connected inside the plastic lamp base 2. A filament 4 is fixedly connected to the filament mount 3. A light-guiding post 5 is fixedly connected to the filament mount 3. The lamp bulb housing 1 is threadedly connected to the plastic lamp base 2. A connecting member 7 for connecting the two conducting wires to the plastic lamp base 2 is disposed on the two conducting wires 6.

The connecting member 7 includes a cover 8 and a copper nail 9. A first fixed block 10 is fixedly connected to a top surface of the plastic lamp base 2. The first fixed block 10 is provided with two first conducting wire grooves 11 each provided with a first insertion hole 12. The cover 8 is provided with two clamping grooves 13. The cover 8 and the first fixed block 10 are plugged to each other. The two conducting wires 6 are slidably connected to the two first conducting wire grooves 11 and the two clamping grooves 13, respectively. The cover 8 is provided with a second insertion hole 14. The conducting wire 6 is provided with a third insertion hole 15. The filament mount 3 is provided with a fourth insertion hole 16. The copper nail 9 is plugged in all the first insertion hole 12, the second insertion hole 14, the third insertion hole 15, and the fourth insertion hole 16.

The two conducting wires 6 are separately placed in the two first conducting wire grooves 11. Two copper nails 9 pass through the first insertion holes 12, the second insertion hole 14, the third insertion hole 15, and the fourth insertion hole 16 to be connected to the filament 4, to rapidly fix the conducting wires 6 on the plastic lamp base 2 and directly transfer electrical energy of the conducting wires 6 to the filament 4 through the copper nails 9. The clamping grooves 13 in the cover 8 are aligned with the conducting wires 6 to plug the cover 8 in the first fixed block 10, so that the conducting wires 6 can be fixed. The apparatus has a simple structure, which greatly improves the efficiency of production, facilitates assembly and disassembly, and makes later use more convenient for people.

Preferably, the first conducting wire groove 11 has a semicircular cross section. An outer side wall of the conducting wire 6 is tightly attached to an inner wall of the first conducting wire groove 11, thereby ensuring that the conducting wire 6 can be stably disposed inside the first conducting wire groove 11.

Preferably, the first insertion holes 12 in the two first conducting wire grooves 11 are staggered from each other to prevent the two copper nails 9 from getting excessively close to cause short circuit of the conducting wires 6.

Preferably, a connecting groove 17 in communication with the first insertion hole 12 is provided in the bottom of the plastic lamp base 2. A connecting post body 18 corresponding to the connecting groove 17 is protrudingly disposed on a surface of the filament mount 3. The fourth insertion hole 16 penetrates the connecting post body 18. The filament mount 3 is plugged in the connecting groove 17 of the plastic lamp base 2 by the connecting post body 18 to implement assembly. Such a design can facilitate the assembly and disassembly of the plastic lamp base 2 and the filament mount 3.

Preferably, a positioning lug 181 is protrudingly disposed on an outer side of one connecting post body 18, and a lug groove 171 is communicatively provided on a side of the connecting groove 17 corresponding to the connecting post body 18. The positioning lug 181 can be used as a basic fool-proof design, to avoid reverse connection of positive and negative electrodes.

It should be noted that the relational terms herein such as first and second are used only to differentiate an entity or operation from another entity or operation, and do not require or imply any actual relationship or sequence between these entities or operations. Moreover, the terms "include", "comprise", or any variation thereof are intended to cover a non-exclusive inclusion. Therefore, in the context of a process, a method, an object, or a device that includes a series of elements, the process, method, object, or device not only includes such elements, but also includes other elements not specified expressly, or may include inherent elements of the process, method, object, or device.

Although the embodiments of the present invention have been shown and described above, a person of ordinary skill in the art can understand that various changes, modifications, replacements, and variations may be made to these embodiments within the principle and spirit of the present invention, and the scope of the present invention is defined by the appended claims and equivalents thereof.

What is claimed is:

1. A connecting structure for a lamp bulb and a lamp base, comprising:

a lamp bulb housing (1) and a plastic lamp base (2), wherein a filament mount (3) is fixedly connected inside the plastic lamp base (2), a filament (4) is fixedly connected to the filament mount (3), a light-guiding post (5) is fixedly connected to the filament mount (3), and the lamp bulb housing (1) is threadedly connected to the plastic lamp base (2); and two conducting wires (6), a connecting member (7) for connecting the two conducting wires (6) to the plastic lamp base (2) being disposed on the two conducting wires (6);

wherein the connecting member (7) comprises a cover (8) and two copper nails (9), a first fixed block (10) is fixedly connected to a top surface of the plastic lamp base (2), the first fixed block (10) is provided with two first conducting wire grooves (11) each provided with a first insertion hole (12), the cover (8) is provided with two clamping grooves (13), the cover (8) and the first fixed block (10) are plugged to each other, the two conducting wires (6) are slidably connected to the two first conducting wire grooves (11) and the two clamping grooves (13) respectively, the cover (8) is provided with a second insertion hole (14), the conducting wire (6) is provided with a third insertion hole (15), the filament mount (3) is provided with a fourth insertion hole (16), each copper nail (9) is plugged in all the first insertion hole (12), the second insertion hole (14), the third insertion hole (15), and the fourth insertion hole (16), and the two conducting wires (6) are electrically connected to the filament mount (3).

2. The connecting structure for the lamp bulb and the lamp base according to claim 1, wherein the first conducting wire groove (11) has a semicircular cross section, and an outer side wall of the conducting wire (6) is tightly attached to an inner wall of the first conducting wire groove (11).

3. The connecting structure for the lamp bulb and the lamp base according to claim 1, wherein the first insertion holes (12) in the two first conducting wire grooves (11) are staggered from each other.

4. The connecting structure for the lamp bulb and the lamp base according to claim 1, wherein a connecting groove (17) in communication with the first insertion hole (12) is provided in the bottom of the plastic lamp base (2), a connecting post body (18) corresponding to the connecting groove (17) is protrudingly disposed on a surface of the filament mount (3), the fourth insertion hole (16) penetrates through the connecting post body (18), and the filament mount (3) is plugged in the connecting groove (17) of the plastic lamp base (2) by the connecting post body (18) to implement assembly.

5. The connecting structure for the lamp bulb and the lamp base according to claim 4, wherein a positioning lug (181) is protrudingly disposed on an outer side of one connecting post body (18), and a lug groove (171) is communicatively provided on a side of the connecting groove (17) corresponding to the connecting post body.

* * * * *